US012280858B2

(12) United States Patent
Xu et al.

(10) Patent No.: US 12,280,858 B2
(45) Date of Patent: Apr. 22, 2025

(54) FLOATING DOCKABLE LIQUEFIED NATURAL GAS SUPPLY STATION

(71) Applicants: CHINA MERCHANTS HEAVY INDUSTRY (JIANGSU) CO., LTD., Jiangsu (CN); CHINA MERCHANTS HEAVY INDUSTRY (SHENZHEN) CO., LTD., Guangdong (CN)

(72) Inventors: Lixin Xu, Nantong (CN); Yuan Yuan, Nantong (CN); Hejing Liu, Nantong (CN); Hui Cao, Nantong (CN); Jiancheng Liu, Nantong (CN)

(73) Assignees: China Merchants Marine Offshore Research Inst. Co., Shenzhen (CN); China Merchants Deepsea Research Inst. (Sanya) Co., Hainan (CN); China Merchants Heavy Industry (Jiangsu) Co., Ltd., Jiangsu (CN); China Merchants Heavy Industry (Shenzhen) Co. Ltd., Shenzhen (CN)

( * ) Notice: Subject to any disclaimer, the term of this patent is extended or adjusted under 35 U.S.C. 154(b) by 740 days.

(21) Appl. No.: 17/597,993

(22) PCT Filed: Apr. 25, 2019

(86) PCT No.: PCT/CN2019/084283
§ 371 (c)(1),
(2) Date: Feb. 1, 2022

(87) PCT Pub. No.: WO2020/172985
PCT Pub. Date: Sep. 3, 2020

(65) Prior Publication Data

US 2022/0289343 A1 Sep. 15, 2022

(30) Foreign Application Priority Data

Feb. 27, 2019 (CN) ..... 201910144019.6

(51) Int. Cl.
*B63B 35/44* (2006.01)
*B63B 21/50* (2006.01)
*B63B 27/34* (2006.01)

(52) U.S. Cl.
CPC ..... *B63B 35/44* (2013.01); *B63B 21/507* (2013.01); *B63B 27/34* (2013.01); *B63B 2035/448* (2013.01)

(58) Field of Classification Search
CPC . B63B 35/44; B63B 2035/448; B63B 21/507; B63B 27/34; B63B 25/16;
(Continued)

(56) References Cited

U.S. PATENT DOCUMENTS 11,959,700 B2 * 4/2024 Brigden ..... F25J 1/0284
12,111,103 B2 * 10/2024 Brigden ..... F25J 1/0022

FOREIGN PATENT DOCUMENTS

CN 206485521 U * 9/2017 ..... B63B 27/24

* cited by examiner

*Primary Examiner* — Daniel V Venne
(74) *Attorney, Agent, or Firm* — Proi Intellectual Property US

(57) ABSTRACT

A floating dockable liquefied natural gas supply station, comprising: a main hull, a bottom base and a positioning system. The bottom base comprises a base plate or at least two base plates. The base plate is securely connected to a lower lateral side of the main hull by means of a splicing securing system. Therefore, the main hull and the bottom base of the floating dockable liquefied natural gas supply station can be assembled in a modular manner. It is possible to individually construct the main hull and bottom base of the floating dockable liquefied natural gas supply station, and to then use a modular method for connecting and assembling same on the ocean or on land, thus being able to flexibly form various types and dimensions of supply station, allowing for docking transport vessels accommodating
(Continued)

various loading capacities of liquefied natural gas (LNG), and reducing the construction cost thereof.

20 Claims, 5 Drawing Sheets

(58) Field of Classification Search
CPC ..... B63B 27/24; B63B 35/003; B63B 1/107; B63B 2001/044; B67D 9/02; B63C 1/04; F17C 5/02; F17C 13/00
USPC ..... 114/256, 264, 266, 267
See application file for complete search history.

FLOATING DOCKABLE LIQUEFIED NATURAL GAS SUPPLY STATION

TECHNICAL FIELD

The present invention relates to the field of liquefied natural gas (LNG) equipment, particularly to a floating dockable liquefied natural gas supply station.

BACKGROUND ART

As environmental protection becomes strongly concerned in the world, more and more countries have begun to legally force the elimination of conventional energies dominated by coal and fuel. The demand for new "clean energies" with natural gas as the mainstay has continued to rise, which in turn has greatly promoted the demand for LNG terminals. For areas with relatively weak infrastructure such as wharves, the use of floating liquefied natural gas supply stations for natural gas supply has obvious advantages.

The offshore liquefied natural gas supply station is an important facility in the natural gas industry chain. It has a core function of receiving, storing and regasifying LNG and finally transporting it to downstream users. Compared with onshore LNG receiving terminals, offshore natural gas supply stations have the advantages of small investment, short construction period, low requirements for configuration of land infrastructure, and reutilization.

The floating installations currently in service usually exhibit high motion amplitude and acceleration in sea waves with poor seakeeping performance, which has an adverse effect on the unloading, regasification and transmission of LNG. Further, the existing floating liquefied natural gas supply stations have relatively high requirements for meteorological conditions in their target sea areas, which limit the use of floating liquefied natural gas supply stations in wider sea areas to some extent.

Further, in order to dock large-tonnage LNG carriers, the main dimensions of the floating liquefied natural gas supply station need to be increased accordingly. In this case, if a large-sized floating liquefied natural gas supply station is built according to the current manufacturing practices, there will be higher requirements for its construction equipment and construction site. Under the existing technology, a larger space of construction equipment and facilities and a larger construction site are needed to build a large-sized floating liquefied natural gas supply station. This limits the feasibility and economy of floating LNG facilities to some extent.

Due to poor seakeeping performance, it is difficult for the existing floating liquefied natural gas supply stations to adapt to docking of large vessels in a harsh wind and wave environment, so it is difficult to meet the requirements of LNG terminals for using in wider waters.

SUMMARY OF THE INVENTION

In order to solve the shortage of existing technology, an objective of the present invention is to provide a floating dockable liquefied natural gas supply station, which docks large LNG carriers on the basis of smaller main dimensions, and improves the overall seakeeping performance by a bottom settling method during docking, thereby being applicable to wider sea areas.

In order to achieve the foregoing objective, the floating dockable liquefied natural gas supply station provided by the present invention comprises a main hull, a bottom base and a splicing securing system. The main hull comprises an LNG storage tank, a natural gas treatment module and a ballast tank; the LNG storage tank is arranged inside the main hull, and the natural gas treatment module is connected to the LNG storage tank; and the ballast tank is arranged in the lower part of the main hull. The bottom base comprises at least one base plate. The splicing securing system comprises a first splicer and a second splicer cooperating with each other, at least one of the first splicer and the second splicer is arranged on the lower lateral surface of the main hull, and the other of the first splicer and the second splicer is correspondingly arranged on at least one lateral surface of the base plate; and the main hull is securely connected to the bottom base by means of the splicing securing system.

Optionally, the foregoing floating dockable liquefied natural gas supply station further comprises a positioning system, which is arranged in the lower part of the main hull or the bottom base to secure the floating dockable liquefied natural gas supply station.

Optionally, in the foregoing floating dockable liquefied natural gas supply station, there are two or more main hulls, and each of the main hulls is securely connected to a lateral side of the base plate on the bottom base by means of the splicing securing system.

Optionally, in the foregoing floating dockable liquefied natural gas supply station, the main hulls are symmetrically arranged on two lateral sides of the bottom base, and are securely connected to the bottom base by means of the splicing securing system.

Optionally, in the foregoing floating dockable liquefied natural gas supply station, the lateral sides of the base plates are respectively provided with the first splicer or the second splicer, and the base plates mutually are securely connected by means of the splicing securing system.

Optionally, in the foregoing floating dockable liquefied natural gas supply station, the bottom base further comprises buttresses or support rails, which are arranged on the top side of the base plate.

Optionally, in the foregoing floating dockable liquefied natural gas supply station, the first splicer is secured and connected to the second splicer by means of welding, buckling, or casting of a binding material.

Optionally, in the foregoing floating dockable liquefied natural gas supply station, the positioning system comprises any one of a mooring system, a dynamic positioning system, a socketing pile positioning system.

Optionally, in the foregoing floating dockable liquefied natural gas supply station, the mooring system comprises a mooring cable, one end of the mooring cable is secured to the seabed, and the other end of the mooring cable is secured to the lower part of the main hull or the lower part of each of the base plates.

Optionally, in the foregoing floating dockable liquefied natural gas supply station, the socketing pile positioning system comprises a plurality of dowel piles, one end of each of the dowel piles is secured to the seabed, and the other end of each of the dowel piles is secured to the lower part of the main hull or the lower part of each of the base plates.

Optionally, in the foregoing floating dockable liquefied natural gas supply station, the floating dockable liquefied natural gas supply station can directly settling down on the seabed to realize positioning.

Compared with existing solutions, the present invention has the following technical effects:

1. The floating dockable liquefied natural gas supply station provided by the present invention comprises: a main hull, a bottom base, and a positioning system. The base comprises a base plate or a splicing securing system with at least two base plates. The base plate additionally is securely connected to the lower lateral side of the main hull by means of the splicing securing system. Therefore, the main hull and the bottom base of the floating dockable liquefied natural gas supply station can be assembled in a modular manner. It is possible to respectively individually construct the main hull and the bottom base of the floating dockable liquefied natural gas supply station, and to then use a modular method for connecting and assembling same on the ocean or on land, thus being able to flexibly form various types and dimensions of a supply station, allowing for docking transport vessels accommodating various loading capacities of liquefied natural gas (LNG).

2. Because the main hull, bottom base and other components in the present invention can be spliced with smaller modular units, it is not necessary to provide a larger construction site and special-purpose large equipment for the construction of large-sized floating liquefied natural gas supply stations. The present invention can effectively reduce the construction costs of large supply stations.
3. Further, the supply station provided by the present invention can cause the LNG carrier to be docked on the bottom base in a bottom settling manner by adjusting the draft between them, so that the LNG carrier and the supply station are combined to form an integral body. Therefore, the floating natural gas supply station provided by the present invention can achieve excellent overall seakeeping performance. In this case, under the influence of external ocean winds, waves, currents and other environments, the supply station and the LNG carrier will realize synchronous movement, essentially without relative displacement, improving operational safety on the ocean. Further, by selecting an appropriate positioning system, such as mooring chain and anchor, socketing pile, or seabed settling, this installation can be applied to sea areas with various water depths from shallow water to deep water, and has much better universality to be applicable to wider sea areas.

Other features and advantages of the present invention will be described in the following description, and partially become evident from the description, or understood through implementation of the present invention.

BRIEF DESCRIPTION OF THE DRAWINGS

The drawings are intended to provide further understanding on the present invention and constitute a part of the description. They are intended to explain the present invention in connection with the embodiment of the present invention and not to limit the present invention. Among the drawings.

DETAILED DESCRIPTION

The preferred embodiments of the present invention are described below in connection with the accompanying drawings. It should be understood that the preferred embodiments described here are intended to illustrate but not to limit the present invention.

Figure 1:
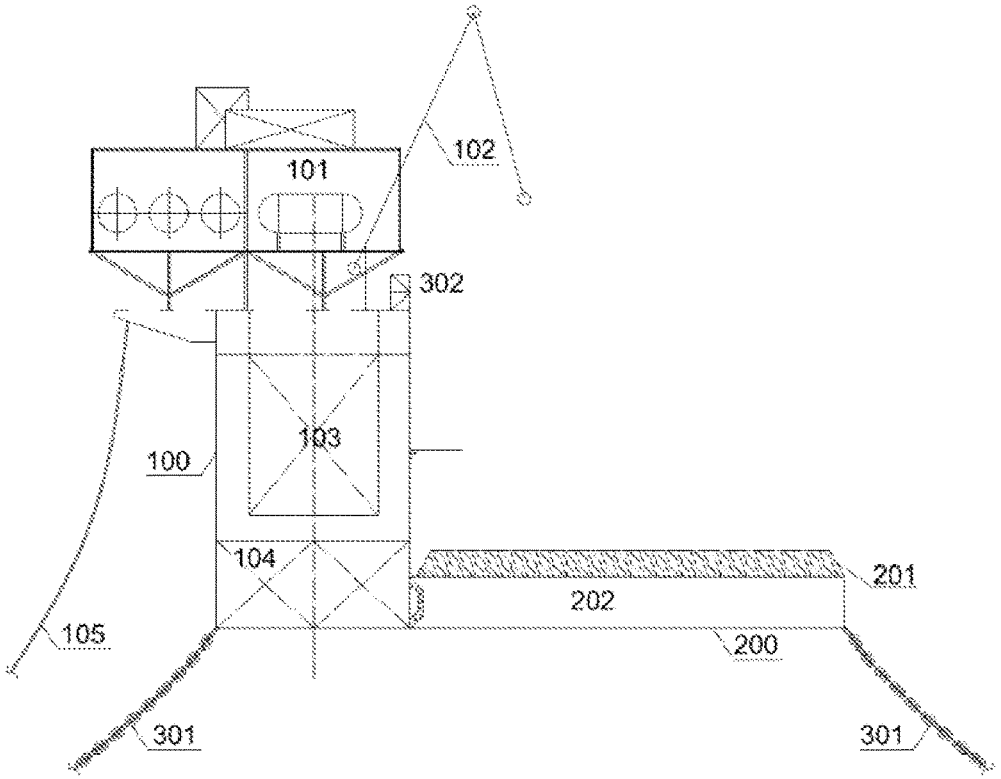
FIG. 1 is a structural schematic view of a floating dockable liquefied natural gas supply station according to the first implementation of the present invention.

As shown in FIG. 1, the present invention provides a floating dockable liquefied natural gas supply station, which is a kind of offshore oil and natural gas production facility. This installation mainly comprises a main hull 100, a bottom base 200, a positioning system 30 and a docking system.

The main hull 100 comprises an LNG storage tank, a cargo containment system, a natural gas treatment module 101 and a ballast tank 104. The natural gas treatment module 101 mainly comprises: a regasification module, an LNG unloading module and a gas transmission module.

The bottom base 200 comprises a support structure composed of a plurality of base plates 202, buttresses or support rails.

Figure 8:
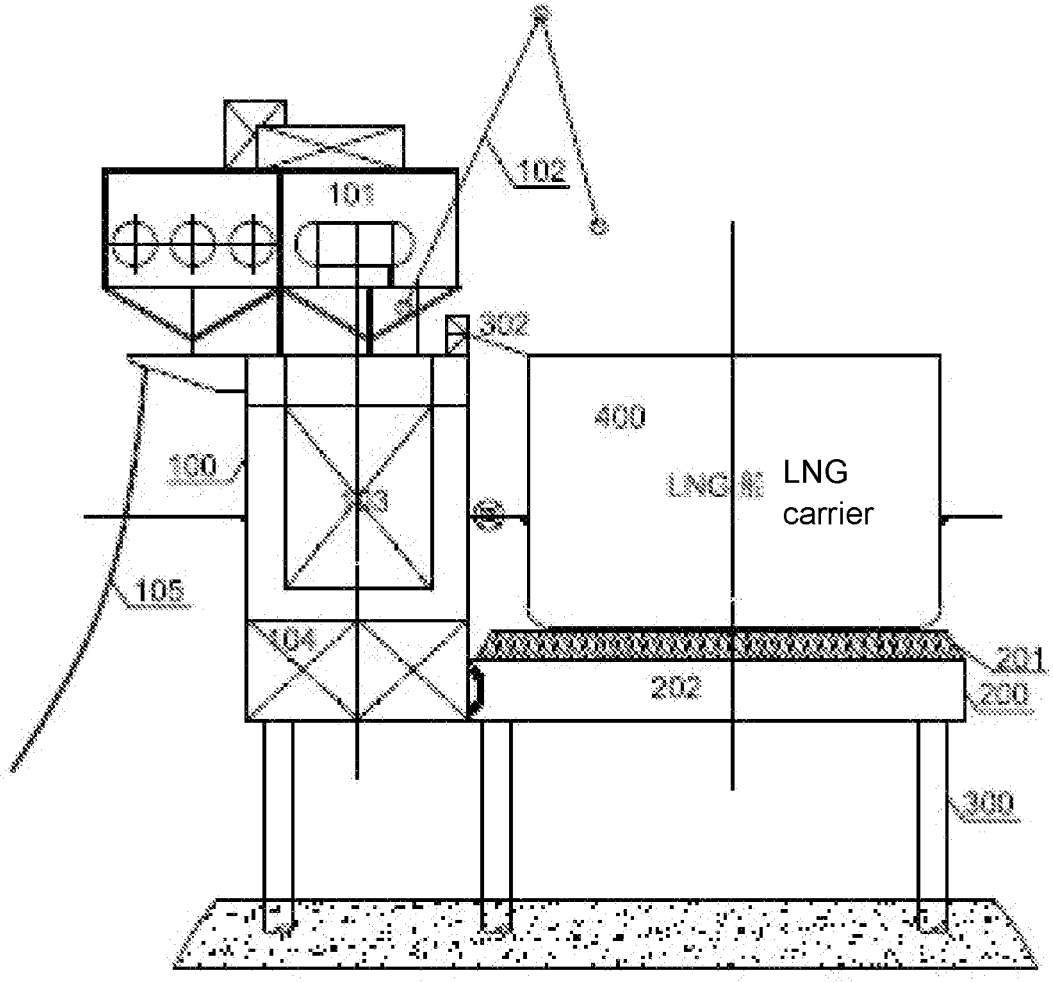
FIG. 8 is a schematic view of a floating dockable liquefied natural gas supply station positioned in a socketing pile method according to a third implementation of the present invention.
Figure 9:
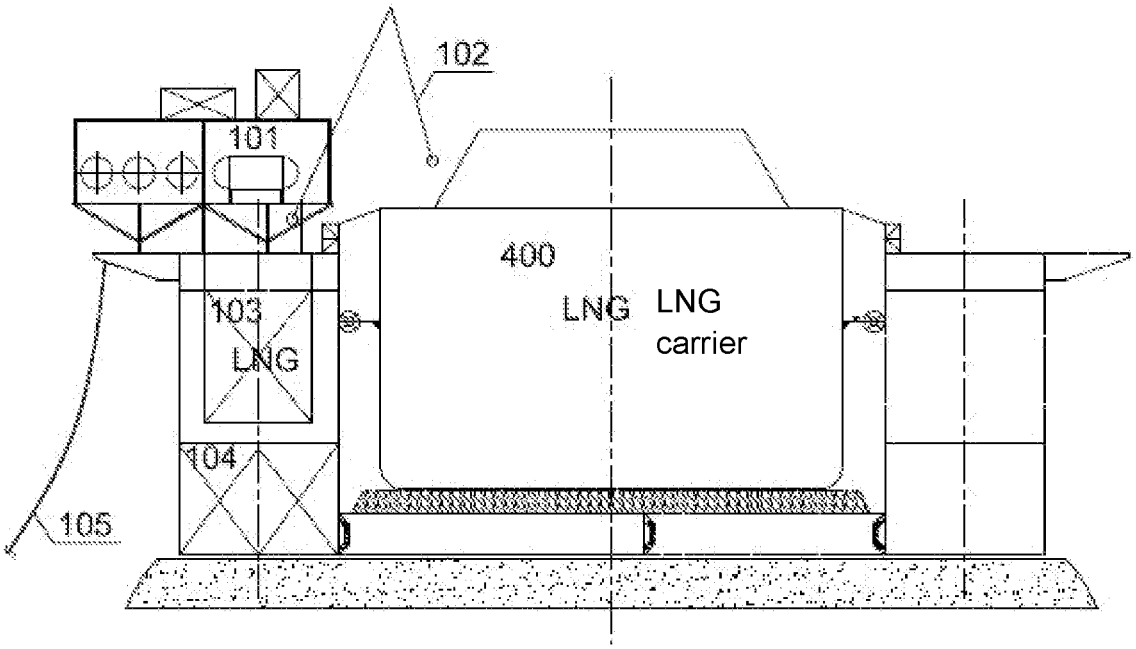
FIG. 9 is a schematic view of a floating dockable liquefied natural gas supply station positioned in the seabed settling manner according to a fourth implementation of the present invention.

The positioning system 30 may adopt various forms, for example: mooring line and anchor as shown in FIG. 1, socketing pile as shown in FIG. 8, and seabed settling as shown in FIG. 9.

The docking system mainly includes connecting ropes 302 and anti-collision fenders. A major special point of the present invention lies in that the main hull and the bottom base can be separately built modularly, respectively, and then are connected modularly on the ocean or on land and combined into supply stations in various geometric shapes. Therefore, supply stations in various types and dimensions can be flexibly formed, and LNG transport carriers with various load capacities can be docked. Besides, the LNG carrier can be docked with the bottom base of the supply station in a bottom settling manner through the buttresses or support rails thereabove, the LNG carrier and the supply station are combined into an integral body, i.e., a supply station-LNG carrier complex is formed, thereby achieving excellent overall seakeeping performance and longering operation window, so that the supply station can adapt to the target sea areas with stricter meteorological conditions and improve operational safety on the ocean. This station does not require a large supply station hull construction site, and shows excellent engineering feasibility.

Figure 5:
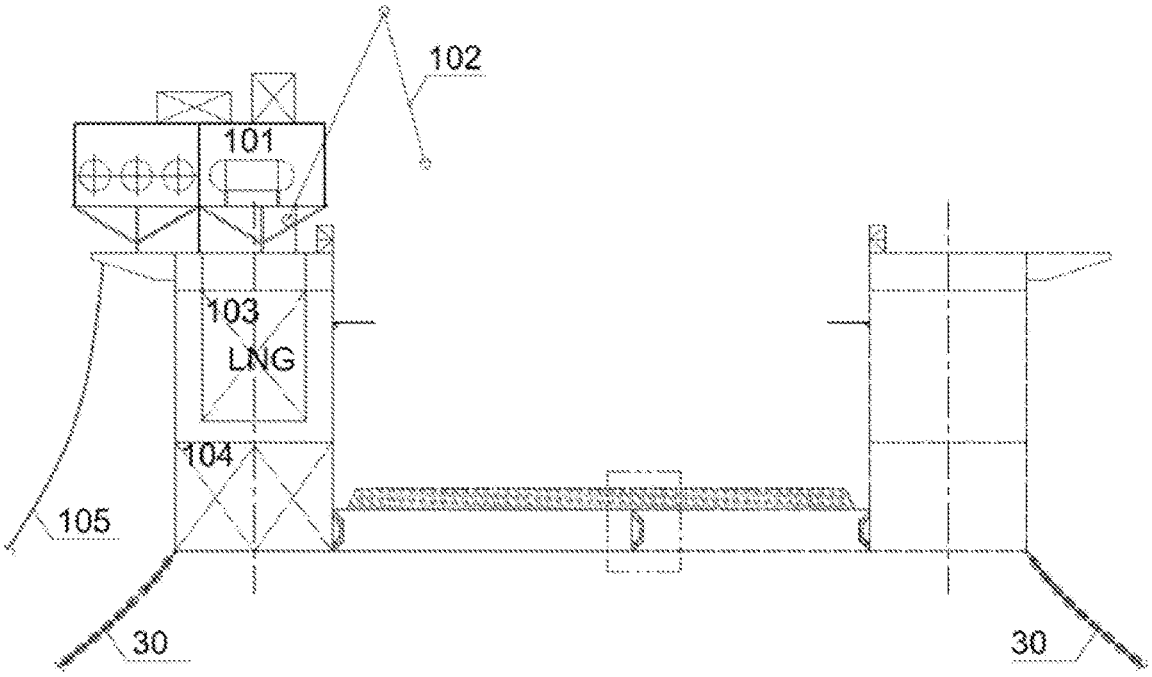
FIG. 5 is a structural schematic view of a floating dockable liquefied natural gas supply station according to the second implementation of the present invention.
Figure 10:
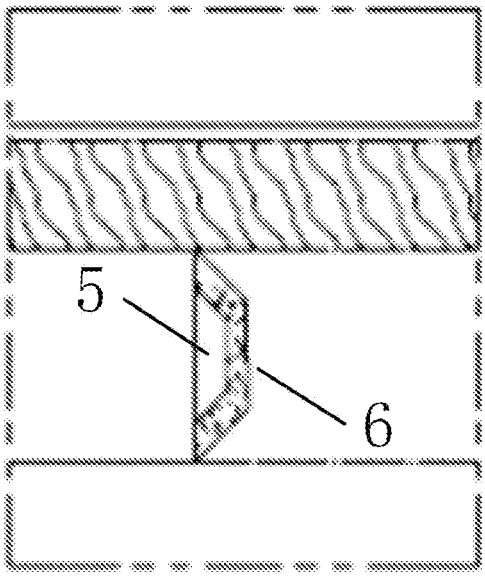
FIG. 10 is a schematic view of the method for connection between two splicers in the floating dockable liquefied natural gas supply station provided by the present invention.

Specifically speaking, under the first implementation of the present invention, as shown in FIG. 1, the lower lateral side of the main hull 100 realizes a free combination between the main hull and the bottom base via a splicing securing system shown in the dotted line box in FIG. 10 or FIG. 5, specifically via a first splicer 5 and a second splicer 6 cooperating with each other. In this way, the main hull 100 and the bottom base 200 are combined into a semi-open or full-open supply station, which can further adapt to LNG carriers in various dimensions.

Under the implementation shown in FIG. 1, in the foregoing supply station, the main hull 100 and the lower part of the bottom base 200 are further connected to a mooring system 301. The mooring system 301 comprises a mooring cable, one end of the mooring cable is secured to the seabed, and the other end of the mooring cable is secured to the lower part of the main hull 100 or the lower part of each of the base plates 202. The mooring system 301 secures a fully open floating supply station comprising the main hull 100 and the bottom base 200 to the seabed to realize long-term docking of the supply station. Under a typical implementation, the foregoing main hull 100 mainly comprises a natural gas treatment module 101, an unloading device 102, an LNG storage tank 103, a ballast tank 104 and a gas transmission pipeline 105. The bottom base 200 mainly comprises buttresses/support rails 201 and a base structure 202.

Figure 2:
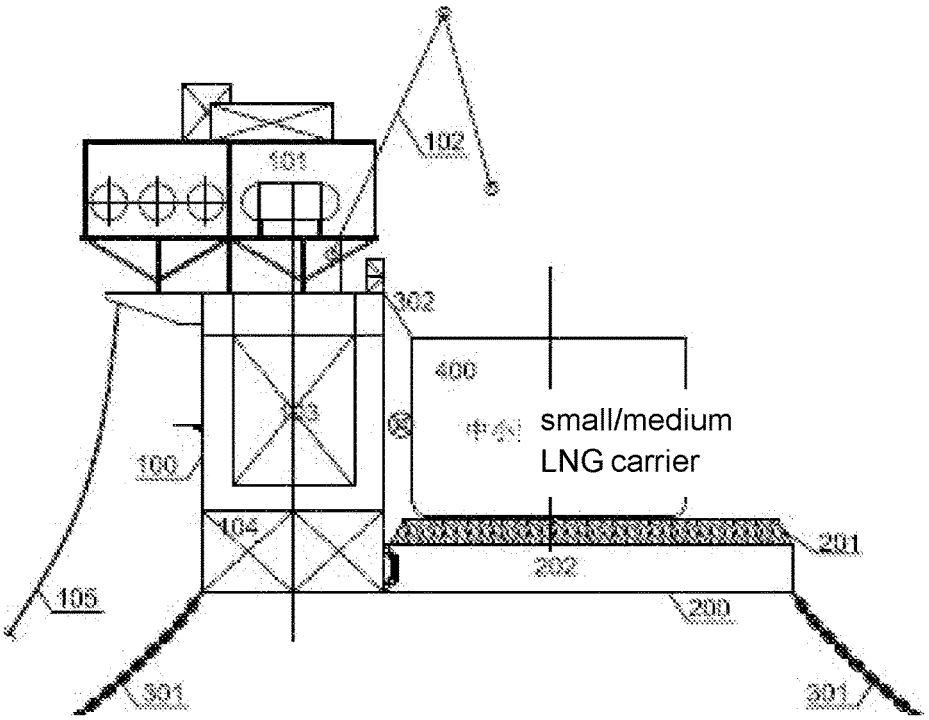
FIG. 2 is a sectional schematic view of the floating dockable liquefied natural gas supply station according to the first implementation of the present invention when a small or medium LNG carrier is docked.

As shown in FIG. 2, the supply station of the present invention lets an LNG transport carrier 400 after arrival to sit on the bottom base 200 by adjusting ballast; by means of the connecting ropes 302, the supply station and the LNG carrier are further connected in an assisted manner. Afterwards, LNG is unloaded from the LNG carrier by the unloading device 102, the natural gas treatment module 101 realizes regasification and gas is continuously supplied to downstream users through the gas transmission pipeline 105 until the LNG carried by the LNG carrier 400 is used up. In this process, the main function of the LNG storage tank 103 is to continue to supply LNG inside the storage tank 103 to users without interruption when the previous LNG transport carrier has left, while next LNG boat 400 has not been fully docked and begun unloading. As docking by the method of bottom settling is adopted, the LNG carrier 400, the main hull 100 and the bottom base 200 form an integral body and essentially do not have relative movement among them. Therefore, the meteorological window and applicable sea areas of the entire installation can be improved significantly.

Figure 3:
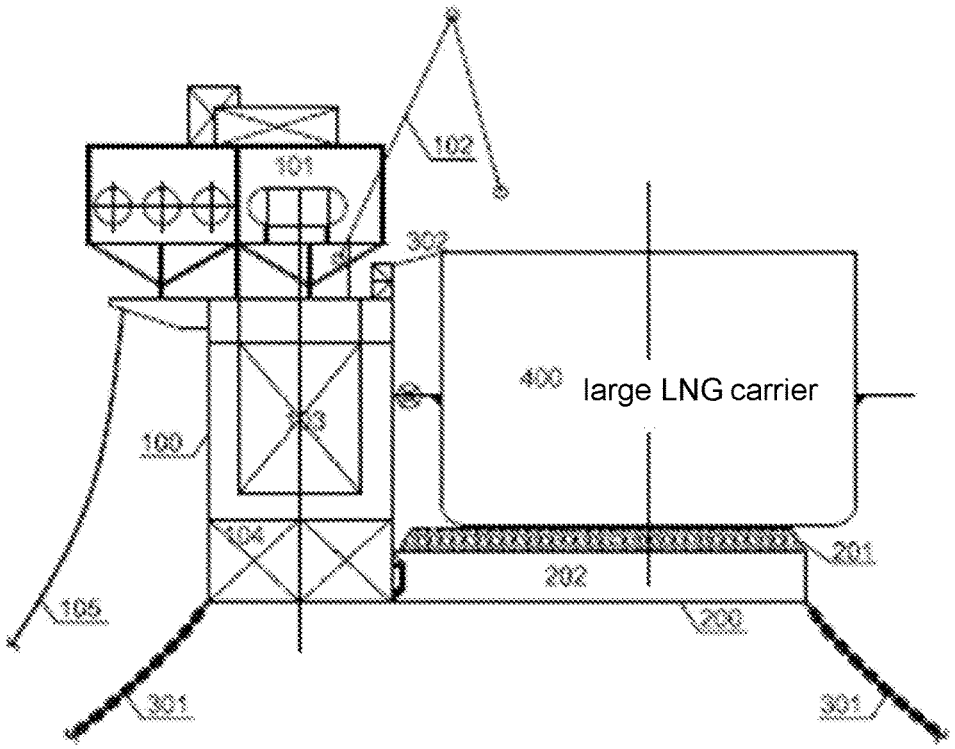
FIG. 3 is a sectional schematic view of the floating dockable liquefied natural gas supply station according to the first implementation of the present invention when a large LNG carrier is docked.
Figure 4:
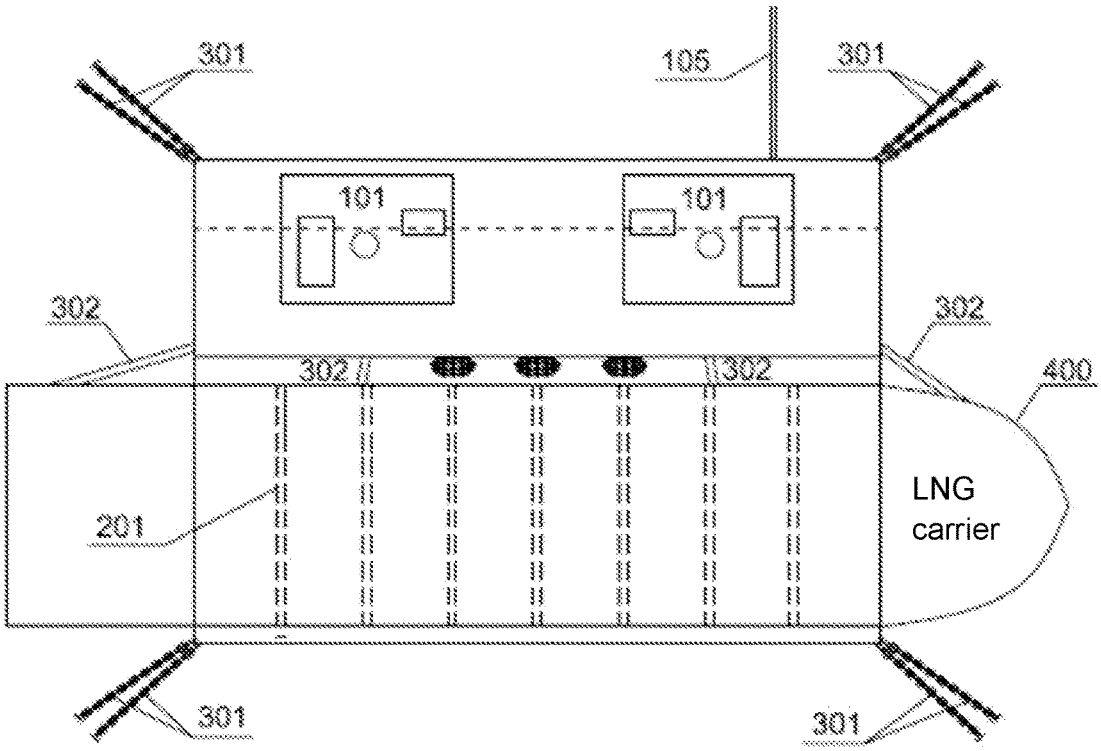
FIG. 4 is a top view of the floating dockable liquefied natural gas supply station according to the first implementation of the present invention when a conventional LNG carrier is docked.

In particular, as shown in FIG. 3, as the supply station combination provided by the present invention is an open structure, supply stations in smaller dimensions allow for the docking of large vessels. Accordingly after a large LNG carrier is docked with the supply station, the LNG carrier can be docked with the bottom base by the bottom settling method through adjusting the draft between them. In this case, the hull bottom of the LNG carrier largely sits on the bottom base. The top view of the connective arrangement is shown in FIG. 4. Therefore, under the influence of external ocean environmental loads of winds, waves and currents, the supply station and the LNG carrier can maintain synchronous movement, essentially without relative displacement, significantly extending the range of sea areas applicable to the supply station.

It is worth noting that the main hull 100 and the bottom base 200 provided by the present invention can be built separately, and then are connected, so the construction is implementable without a large construction site.

Figure 6:
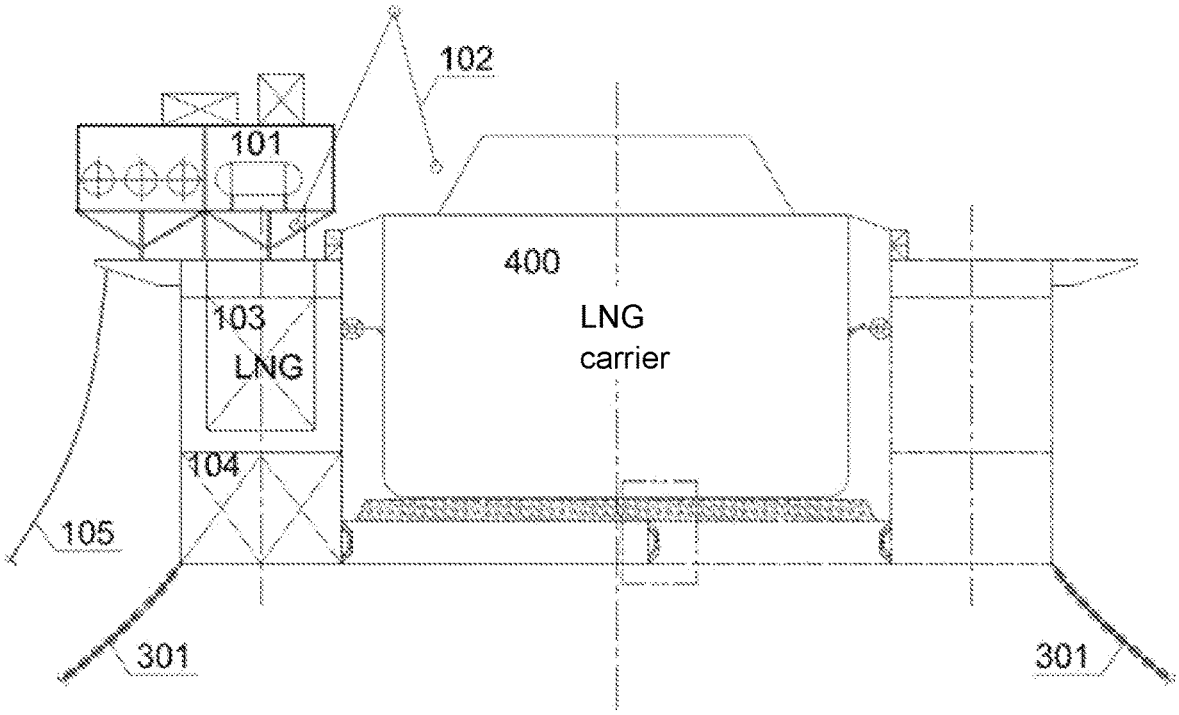
FIG. 6 is a sectional schematic view of the floating dockable liquefied natural gas supply station according to the second implementation of the present invention when a super large LNG carrier is docked.
Figure 7:
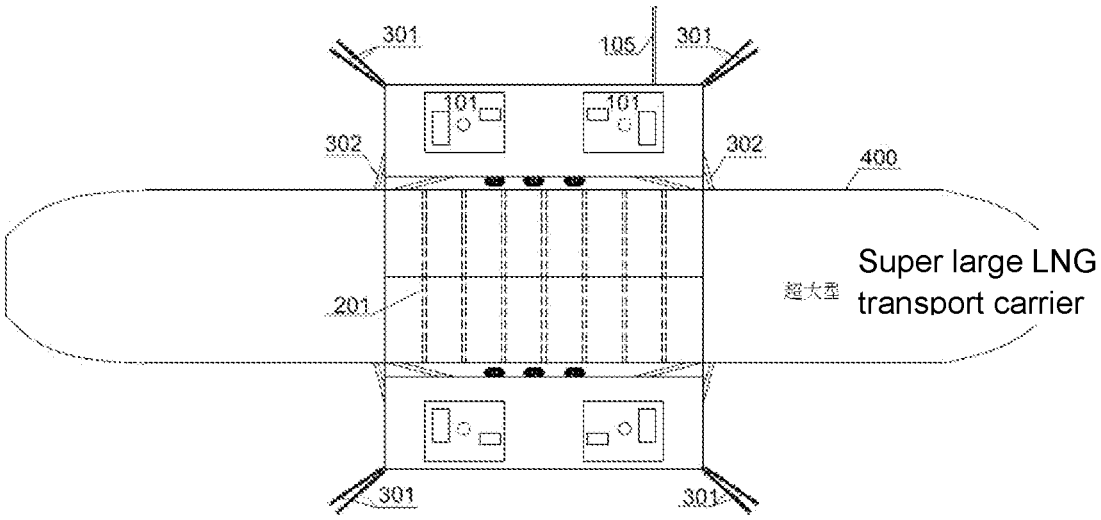
FIG. 7 is a top view of the floating dockable liquefied natural gas supply station according to the second implementation of the present invention when a super large LNG carrier is docked.

Under the second implementation of the present invention, as shown in FIG. 5, the target users of this supply station are super large LNG transport carriers, so its main dimensions, the width in particular, are relatively large. In this case, two sets of modules of main hulls 100 and bottom bases 200 can be adopted and abutted left and right to form a semi-open structure, for docking LNG carriers. Under this method, the bottom settling docking is shown in FIG. 6 or FIG. 7 for a super large LNG carrier. Other subsequent operations are similar to those in the previous embodiment.

Under the third implementation of the present invention, as shown in FIG. 8, the positioning method of this supply station is socketing pile positioning. The socketing piles or dowel piles 300 can be inserted into the seabed by offshore constructure to realize long-term positioning of the entire supply station installation. The specific operating method of this supply station is similar to that of the foregoing embodiment and is not described again.

As shown in FIG. 9, under the fourth implementation of the present invention, the supply station may also sit as a whole on the seabed by adjusting the ballast tank 104, to realize long-term positioning. In the splicing securing system, the first splicer 5 is secured and connected to the second splicer 6 by means of welding, buckling, or casting of a binding material, thereby causing the base plates 202 and the main hulls 100 to be connected into an integral body.

The floating dockable liquefied natural gas supply station provided by the present invention adopts a modular design, so it has the following adjustable degrees of freedom:

- The interface division of the main hull, the bottom base, the positioning system and the docking system can be freely selected according to needs;
- The docking devices between the supply station and the LNG carrier, such as connecting ropes and fenders, as well as related operating mechanical systems, can be freely selected according to needs;
- The combination method of the main hull and the bottom base can be freely selected according to needs to form various types of supply stations;
- The external shapes and main dimensions of the main hull and the bottom base can be freely selected according to needs;
- The method and principle of adjusting the draft of the supply station and the LNG carrier, so that the LNG boat is docked with the supply station by the bottom settling method, can be appropriately selected according to the needs;
- The extension deck structure of the main hull can be freely selected according to needs, the form and geometric dimensions of the extension deck structure of the main hull can be further optimized, or no extension deck is provided;
- The connection system between the main hull and the bottom base can be freely selected according to needs, for example, its connection method, connector, connection material, etc. are selected;
- The construction method and process flow of the connection between the main hull and the bottom base on land and/or the ocean can be freely selected according to needs;
- In the supply station, the geometric form, dimensions and position of the LNG cabin can be freely selected according to needs;
- In the supply station, the type of the LNG cargo containment system can be freely selected according to needs;

In the supply station, the setting, increase and decrease of LNG unloading, storage, regasification, transmission and other functions can be freely selected according to needs;

In the supply station, the interior design of LNG unloading, storage, regasification, transmission and other subsystems can be freely selected according to needs;

In the supply station, the setting, increase and decrease of ballast capabilities can be freely selected according to needs;

In the supply station, the cabin of the ballast tank and its geometric form, dimensions and position can be freely selected according to needs;

In the supply station, the ballast can be freely selected according to needs; The structural form, main material, arrangement form, spacing and quantity of the buttresses/support rails can be freely selected according to needs;

The positioning system may adopt a mooring mode, and the arrangement of the mooring system, the composition of the mooring line, the main material of the mooring line, the intermediate joints, the terminal joints, the anchoring method of the mooring system on the seabed, the anchoring device, and the mechanical system for the mooring system control can be freely selected according to needs;

The positioning system may adopt socketing piles, the layout, structural dimensions and main material of the socketing piles or dowel piles, mechanical control system of the socketing pile and the principle to implement the socketing piles positioning system can be freely selected according to needs;

The supply station installation as a whole can adopt the direct bottom settling method. The principle of the method, the mechanical control system, necessary local reinforcement of the hull bottom and the pretreatment conditions of seabed foundation can be freely selected according to needs;

Other positioning methods and systems can be freely selected according to needs, such as a dynamic positioning system;

The connection method above water surface between the supply station and the LNG carrier, and the control mechanism can be freely selected according to needs;

The supply station can be freely selected according to needs to possess the self-propulsion capability.

Therefore, the present invention has the following advantages:

The main hulls and the bottom bases can be conveniently combined into various geometric forms of supply stations, such as semi-open form or full-open form, so that supply stations in small dimensions allow docking of large LNG transport carriers.

The modular design can significantly reduce the requirements for the scale of the construction site and the facilities, and existing construction facilities near the target sea area can be used for the supply station construction. This provides greater flexibility and broader applicability for its practical applications and reduces the engineering construction period and cost. A modular method is used to design and manufacture the main hulls and the bottom bases, respectively. Through free combination of the main hulls and the bottom bases, floating supply stations in various types can be realized flexibly, such as semi-open form and full-open form, so that the entire installation can adapt to the docking of LNG carriers in various dimensions including docking of a large LNG carrier with small supply stations. The modular construction method can also realize manufacturing in a smaller construction site.

The floating dockable liquefied natural gas supply station of the present invention provides an excellent docking method for LNG carriers. An LNG carrier can directly sit on the buttresses/support rails of the bottom base of the supply station to form a supply station-LNG carrier combination structure, thereby significantly improving the overall seakeeping performance and the meteorological window for operation, so that the installation is adaptable to wider sea areas. The bottom settling method of LNG carriers significantly reduces the relative movement between the supply station and the LNG carrier. Compared with the conventional side-by-side docking method, the meteorological window for operation of this installation is improved by at least 40%-50%. Further, when a socketing pile or seabed is adopted for bottom settling, the operational window will be even wider.

By reasonably selecting a type of the positioning system, such as mooring chain and anchor, socketing pile, or seabed settling, this installation can be applied to sea areas with various water depths from shallow water to deep water, and has much better universality to further extend its applicable sea areas. For example, in a shallow sea area, it can directly sit on the seabed; in a sea area with a medium water depth, positioning can be achieved through socketing piles; in deep sea, mooring positioning can be adopted.

This installation can adopt a structural form of extension deck, so a larger deck area can be obtained without increasing the main dimensions of the hull, to provide an enough operating space.

The entire supply station installation features small investment and short construction period, does not need large onshore wharf infrastructure and can be operated movably in different marine environments, thereby possessing excellent lifecycle economy.

The structural forms of the buttresses/support rails can reduce the local load when an LNG carrier is docked on the bottom, so that LNG carriers with a large carrying capacity can be docked in the supply station by the bottom settling method.

The optimal design of the liquid tank in the supply station can be applied to various kinds of LNG cargo containment systems, particularly is suitable for LNG storage in a C-shaped storage tank, thereby reducing the total cost.

The entire installation has complete functions, possesses all the functions such as docking of LNG carriers, and LNG unloading, storage, regasification and transmission, and can realize independent operation.

LNG unloading, regasification, transmission and other process modules can adopt a compact design to further reduce the requirements for the deck area and main dimensions of the main hull, thereby reducing the cost of the entire installation.

The entire installation can adopt an open-type overall layout design to significantly improve the safety when an LNG carrier is docked or leaves.

Those of ordinary skills in the art can understand that the foregoing descriptions are preferred embodiments of the present invention and are not intended to limit the present invention, and although the present utility model has been elaborated by referring to the foregoing embodiment, those skilled in the art still can modify the technical solutions of the foregoing embodiments, or equivalently replace some of the technical features therein. All modifications, identical replacements and improvements made without departing from the spirit and principle of the present invention shall be within the protection scope of the present invention.

The invention claimed is:

1. A floating dockable liquefied natural gas supply station, wherein the supply station comprises:

a main hull, comprising: an LNG storage tank, a natural gas treatment module and a ballast tank; the LNG storage tank being arranged inside the main hull, the natural gas treatment module being connected to the LNG storage tank, and the ballast tank being arranged in a lower part of the main hull;

a bottom base, comprising at least one base plate;

a splicing securing system, comprising a first splicer and a second splicer cooperating with each other, at least one of the first splicer and the second splicer being arranged on a lower lateral side of the main hull, an other of the first splicer and the second splicer being correspondingly arranged on at least one lateral side of the base plate, and the main hull being securely connected to the bottom base by means of the splicing securing system; and a positioning system, arranged in the lower part of the main hull or the bottom base to secure the floating dockable liquefied natural gas supply station.

2. The floating dockable liquefied natural gas supply station according to claim 1, wherein there are two or more main hulls, and each of the main hulls is securely connected to a lateral side of the base plate by means of the splicing securing system.

3. The floating dockable liquefied natural gas supply station according to claim 2, wherein the main hulls are symmetrically arranged on two lateral sides of the bottom base, and are securely connected to the bottom base by means of the splicing securing system.

4. The floating dockable liquefied natural gas supply station according to claim 1, wherein lateral sides of the base plates are respectively provided with the first splicer or the second splicer, and the base plates mutually are securely connected by means of the splicing securing system.

5. The floating dockable liquefied natural gas supply station according to claim 1, wherein the bottom base further comprises buttresses or support rails, which are arranged on top side of the base plate.

6. The floating dockable liquefied natural gas supply station according to claim 4, wherein the first splicer is secured and connected to the second splicer by means of welding, buckling, or casting of a binding material.

7. The floating dockable liquefied natural gas supply station according to claim 1, wherein the positioning system comprises any one of a mooring system, a dynamic positioning system, a socketing pile positioning system.

8. The floating dockable liquefied natural gas supply station according to claim 1, wherein the mooring system comprises a mooring cable, one end of the mooring cable is secured to a seabed, and an other end of the mooring cable is secured to the lower part of the main hull or the lower part of each of base plates.

9. The floating dockable liquefied natural gas supply station according to claim 7, wherein a socketing pile positioning system comprises a plurality of dowel piles, one end of each of the dowel piles is secured to a seabed, and an other end of each of the dowel piles is secured to the lower part of the main hull or the lower part of each of the base plates.

10. The floating dockable liquefied natural gas supply station according to claim 7, wherein the floating dockable liquefied natural gas supply station adopts a directly settling down on a seabed to realize positioning.

11. The floating dockable liquefied natural gas supply station according to claim 4, wherein the bottom base further comprises buttresses or support rails, which are arranged on top side of the base plate.

12. The floating dockable liquefied natural gas supply station according to claim 2, wherein the positioning system comprises any one of a mooring system, a dynamic positioning system, a socketing pile positioning system.

13. The floating dockable liquefied natural gas supply station according to claim 2, wherein said any one of the mooring system comprises a mooring cable, one end of the mooring cable is secured to a seabed, and an other end of the mooring cable is secured to the lower part of the main hull or the lower part of each of base plates.

14. The floating dockable liquefied natural gas supply station according to claim 12, wherein a socketing pile positioning system comprises a plurality of dowel piles, one end of each of the dowel piles is secured to a seabed, and an other end of each of the dowel piles is secured to the lower part of the main hull or the lower part of each of the base plates.

15. The floating dockable liquefied natural gas supply station according to claim 12, wherein the floating dockable liquefied natural gas supply station adopts a directly settling down on a seabed to realize positioning.

16. The floating dockable liquefied natural gas supply station according to claim 3, wherein the positioning system comprises any one of a mooring system, a dynamic positioning system, a socketing pile positioning system.

17. The floating dockable liquefied natural gas supply station according to claim 3, wherein the mooring system comprises a mooring cable, one end of the mooring cable is secured to a seabed, and an other end of the mooring cable is secured to the lower part of the main hull or the lower part of each of base plates.

18. The floating dockable liquefied natural gas supply station according to claim 16, wherein a socketing pile positioning system comprises a plurality of dowel piles, one end of each of the dowel piles is secured to a seabed, and an other end of each of the dowel piles is secured to the lower part of the main hull or the lower part of each of the base plates.

19. The floating dockable liquefied natural gas supply station according to claim 16, wherein the floating dockable liquefied natural gas supply station adopts a directly settling down on a seabed to realize positioning.

20. The floating dockable liquefied natural gas supply station according to claim 4, wherein the positioning system comprises any one of a mooring system, a dynamic positioning system, a socketing pile positioning system.

* * * * *